US007537115B2

(12) United States Patent
Weaver

(10) Patent No.: US 7,537,115 B2
(45) Date of Patent: May 26, 2009

(54) DISPLAY APPARATUS FOR IMPLEMENTS WITH HANDLES AND WORKING ENDS

(75) Inventor: Jace Weaver, Gilbertsville, PA (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 414 days.

(21) Appl. No.: 11/347,534

(22) Filed: Feb. 3, 2006

(65) Prior Publication Data

US 2007/0181457 A1 Aug. 9, 2007

(51) Int. Cl.
*A44B 21/00* (2006.01)

(52) U.S. Cl. ..... 206/361; 206/443; 206/461; 206/806; 206/349; 206/477

(58) Field of Classification Search ..... 206/443, 206/6.1, 495, 566, 468, 461, 486, 379, 807, 206/324, 690, 349, 477, 348, 470, 361, 806
See application file for complete search history.

(56) References Cited

U.S. PATENT DOCUMENTS

| | | | | | |
|---|---|---|---|---|---|
| 1,194,894 | A | | 8/1916 | Standefer | |
| 2,795,834 | A | * | 6/1957 | Szoke | 248/113 |
| 3,684,223 | A | * | 8/1972 | Logsdon | 248/74.3 |
| 3,778,537 | A | * | 12/1973 | Miller | 174/138 R |
| D264,682 | S | * | 6/1982 | Van Doren | D8/354 |
| 4,550,829 | A | * | 11/1985 | Strahs | 206/361 |
| 5,669,590 | A | * | 9/1997 | Przewodek | 248/68.1 |
| 5,725,185 | A | * | 3/1998 | Auclair | 248/74.2 |
| 5,730,290 | A | * | 3/1998 | Futo | 206/349 |
| 5,871,189 | A | * | 2/1999 | Hoftman | 248/229.16 |
| 6,109,569 | A | * | 8/2000 | Sakaida | 248/75 |
| 6,709,196 | B1 | * | 3/2004 | Medendorp | 206/349 |
| 6,715,721 | B2 | * | 4/2004 | Buck | 248/74.2 |
| 2004/0265053 | A1 | | 12/2004 | Weaver | |
| 2005/0029147 | A1 | | 2/2005 | Lee et al. | |
| 2007/0034533 | A1 | * | 2/2007 | Coldrey et al. | 206/5.1 |

OTHER PUBLICATIONS

International Search Report in PCT/US07/61097.

* cited by examiner

*Primary Examiner*—Byron P Gehman
*Assistant Examiner*—Andrew Perreault
(74) *Attorney, Agent, or Firm*—Wildman, Harrold, Allen & Dixon LLP

(57) ABSTRACT

An apparatus for carrying an implement comprising a handle and a working end comprises an engagement member for releasably securing a handle to the apparatus and a receptacle positioned in substantial alignment with the engagement member. The engagement member may be a post comprising a catch or a threaded section positioned on a front surface of the apparatus. The apparatus may further include first and second receptacles for retaining at least a portion of the handle of the implement.

18 Claims, 4 Drawing Sheets

DISPLAY APPARATUS FOR IMPLEMENTS WITH HANDLES AND WORKING ENDS

FIELD OF THE INVENTION

This invention relates to a display apparatus and more particularly to a display apparatus for carrying an implement comprising a handle and a working end, such as a cleaning implement.

BACKGROUND

Implements comprising handles and working ends, such as mops and brooms, are displayed to customers in a retail environment in various ways. Pegboards, in connection with wire support members, have been widely used for this purpose. Typically, implements are hung on the wire support members through a hole in the handle or in packaging used in connection with the implement. Blister packs are one type of known packaging.

There is a need for an easy to use display apparatus that can be employed with existing display systems or otherwise.

SUMMARY

The present invention relates to an improved display apparatus for carrying an implement comprising a handle and a working end.

Briefly, the apparatus comprises a front surface and a rear surface, the front surface comprising an engagement member for releasably securing a handle to the apparatus and a receptacle for holding a portion of the handle. The term "receptacle," as used herein, means a structure or device for restricting movement of a portion of a handle in two or more directions. The term "engagement member" means a structure or device for securing the handle to the apparatus, such as a post or threaded area in select embodiments of the present invention. The term "releasably securing" means that the engagement member is constructed so that the handle is capable of being secured to and removed from the apparatus so that the display apparatus can be reused.

In one embodiment, the display apparatus comprises a top portion comprising a front surface and a rear surface, the front surface comprising a threaded section and a post transverse to the front surface, a cover connected to the top portion and first and second receptacles defined by the cover and top portion. The top portion may further comprise a hole for hanging the apparatus on a hook. The rear surface may be constructed of a flexible material and may comprise a plurality of undercuts for receipt of a card comprising product information. Alternatively, the cover may comprise a raised surface for carrying a label with product information. To facilitate engagement, the post may comprise a catch for engaging an aperture positioned in the handle. The first and second receptacles may exhibit various configurations. Typically, the first receptacle is in substantial alignment with the threaded portion while the second receptacle is in substantial alignment with the post. One of the receptacles may comprise a greater width dimension than the other.

In another embodiment, the apparatus comprises a top portion comprising a front surface and a rear surface, the front surface comprising a threaded section and a post transverse to the front surface, a first receptacle positioned in substantial alignment with the threaded portion and a second receptacle positioned in substantial alignment with the post. The post may comprise a catch for engaging the handle and the top portion may be constructed of a flexible material to allow disengagement of the post from the handle. At least one of the first and second receptacles may comprise a concave surface. One of the first and second receptacles comprises a greater width dimension than the other.

In yet another embodiment, the apparatus comprises a front surface and a rear surface, the front surface comprising at least one engagement member for releasably securing the handle to the apparatus and at least one receptacle positioned in substantial alignment with the engagement member, the receptacle for retaining at least a portion of the handle. Opposing lateral support members may be positioned between and connected to the top portion and a bottom portion of the apparatus.

An implement used with the apparatus may comprise a two-part elongated handle comprising a handle portion connected to a working end and a handle attachment member for lengthening the handle portion. The handle portion may engage the post while the handle attachment member may engage the threaded portion, or vice versa. Regardless, with an implement installed on the apparatus, a length from a top portion of the handle to a bottom portion of the working end may be about 40.0 inches.

BRIEF DESCRIPTION OF THE DRAWINGS

Certain embodiments of the presently claimed invention are illustrated by the accompanying figures. It should be understood that the figures are not necessarily to scale and that details that are not necessary for an understanding of the invention or that render other details difficult to perceive may be omitted. It should be understood, of course, that the invention is not necessarily limited to the particular embodiments illustrated herein.

DETAILED DESCRIPTION

The present invention relates to a display apparatus for carrying implements comprising handles and working ends. The implements may, for example, be cleaning implements, such as mops, brooms, dusters, long-handled garden implements, such as rakes or garden hoes, or any other such implements. The term "working end," as used herein, means a portion of an implement attached to an end of a handle and capable of performing a function, such as the bristle portion on a broom or the sponge portion of a mop. The implements may be manufactured by methods known to those of skill in the art.

Figure 1:
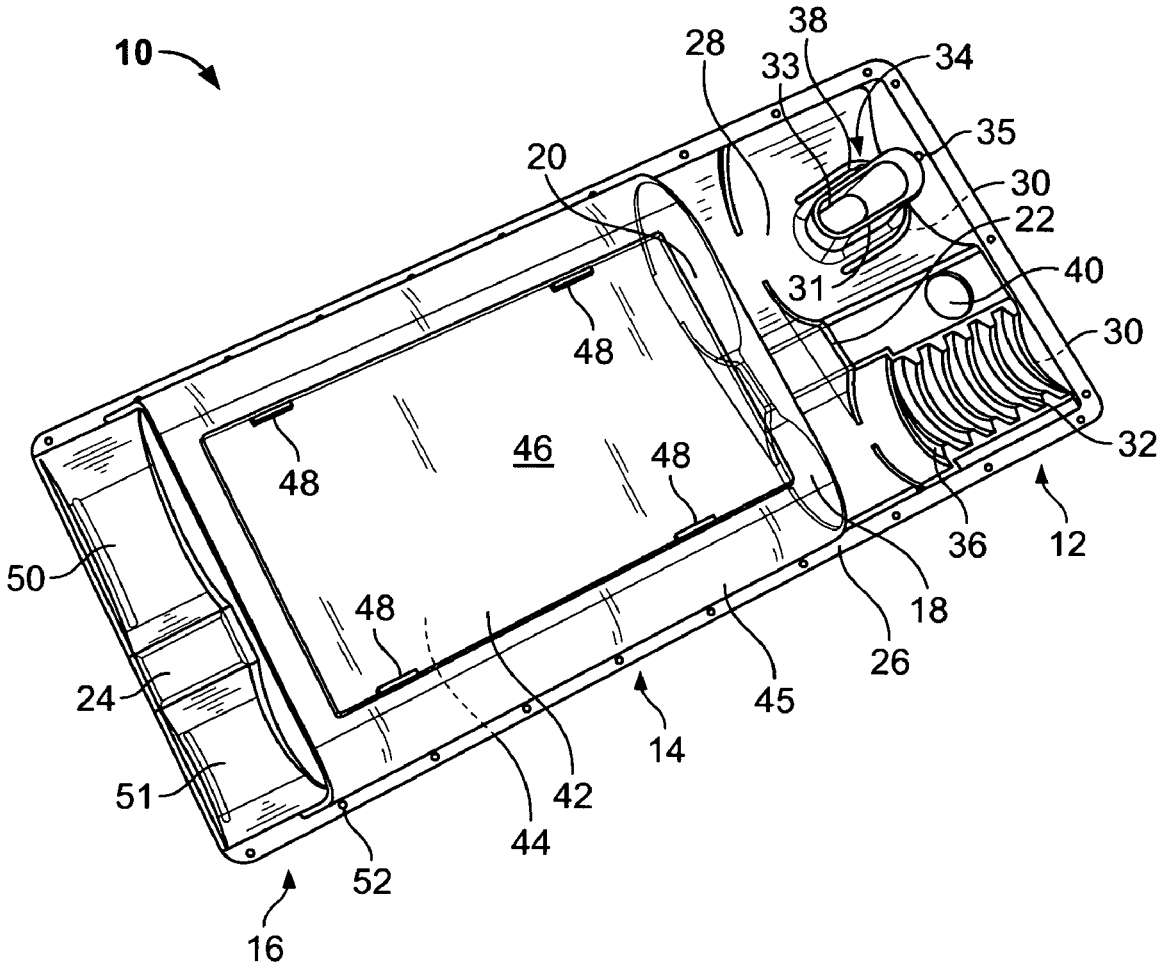
FIG. 1 is a perspective view of one embodiment of the apparatus of the present invention.
Figure 2:
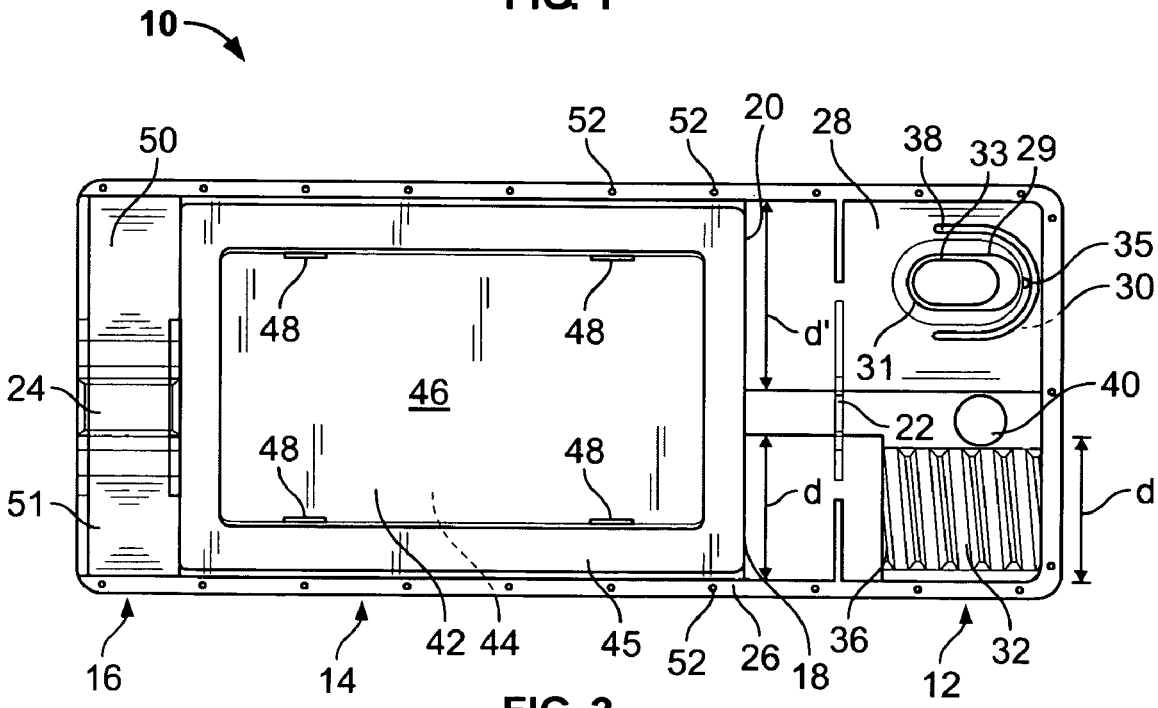
FIG. 2 is a bottom plan view of FIG. 1.

Referring now to FIGS. 1 and 2, one embodiment of the apparatus 10 of the present invention is shown. Apparatus 10 comprises top portion 12, cover 14, bottom portion 16, first and second receptacles 18 and 20, first and second separators 22 and 24 and peripheral flat edges 26.

Top portion 12 comprises front surface 28 and rear surface 30. Front surface 28 comprises threaded portion 32 and post 34. Threaded portion 32 optionally includes chamfer 36. Post 34 is positioned transverse to front surface 28 and may include opposing sidewalls 29 and 31 and angled surface 33. Post 34 may further comprise catch 35. Although catch 35 may take other forms, as shown in FIG. 1, catch 35 comprises a raised surface or rib on top of post 34. Slot 38 may be positioned around at least a portion of post 34. Top portion 12 may further comprise hang hole 40 for hanging apparatus from a hook on a display rack and first separator 22, positioned in alignment with a longitudinal axis between threaded portion 32 and post 34.

Cover 14 may be positioned between top portion 12 and bottom portion 16 and connected thereto. Cover 14 comprises forward facing surface 42 and rearward portion 44 and may comprise curved surface 45. Front portion 42 may comprise raised surface 46, to which a label carrying product information may be affixed. Additionally or alternatively, rear portion 44 may comprise a plurality of undercuts 48 positioned uniformly or non-uniformly around the periphery of rear portion 44. Undercuts 48 are adapted to receive and hold a card carrying product information. The orientation of cover 14 may be reversed so that its forward facing surface 42 is oriented toward the rear of apparatus 10.

Bottom portion 16 may comprise retaining receptacles 50 and 51, with second separator positioned 24 therebetween. Retaining receptacles 50 and 51 may comprise concave surfaces, which typically conform to the shape of a handle.

Figure 5:
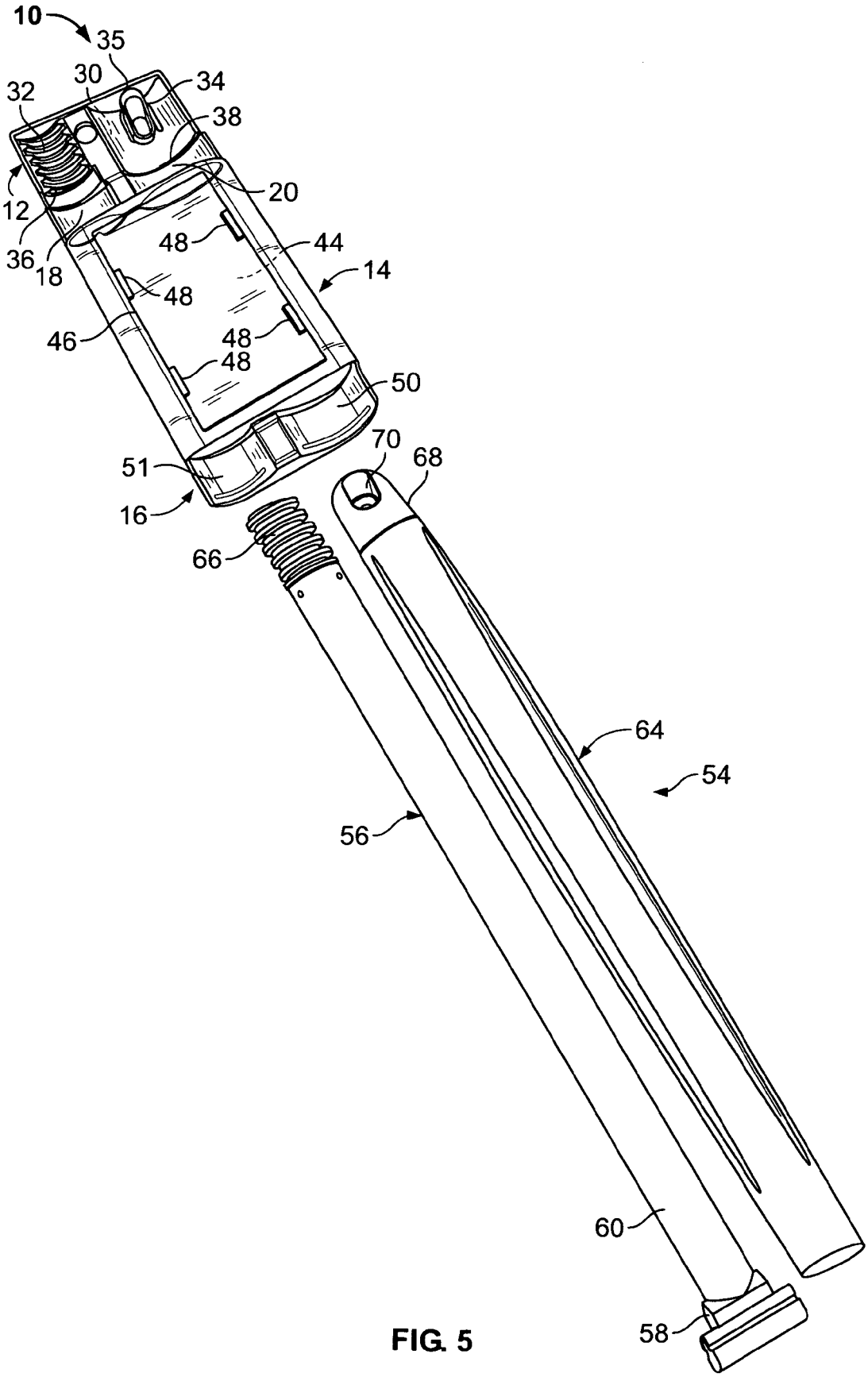
FIG. 5 is an exploded perspective view of a two-part elongated handle and the apparatus of FIG. 1.
Figure 6:
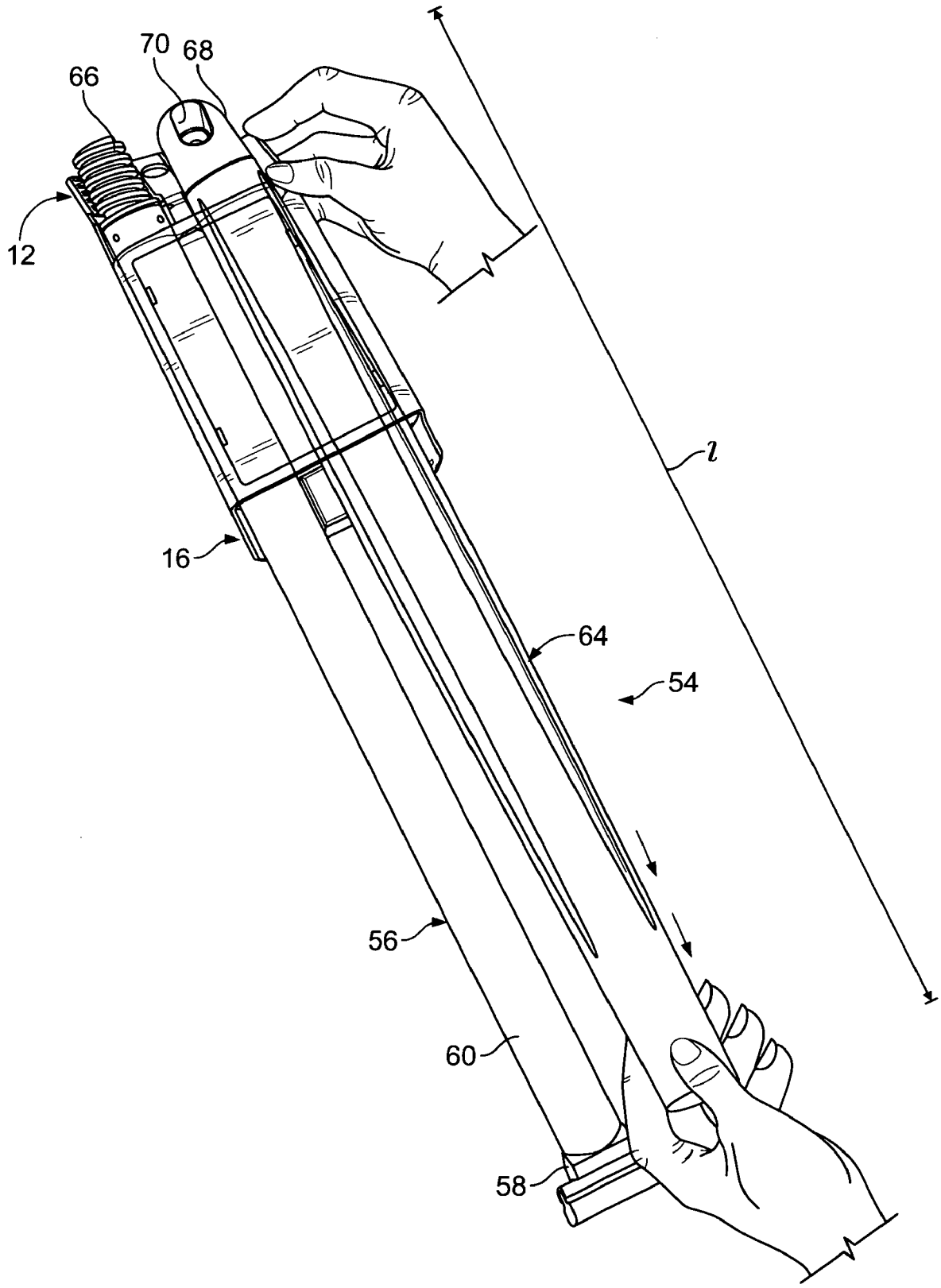
FIG. 6 is a perspective view of a user removing a portion of the handle from the apparatus of FIG. 4.

First and second receptacles 18 and 20 may be defined by top portion 12 and cover 14. First receptacle 18 is typically positioned in substantial alignment with threaded portion 32, while second receptacle 20 is typically positioned in substantial alignment with post 34. Depending on the dimensions of the implement to be positioned within apparatus 10, one of first and second receptacles 18 and 20 may comprise a greater width dimension than the other. For example, first receptacle 18 may comprise a width dimension d between about 0.75 inches to 1.0 inch, between about 0.825 and about 0.925 and more particularly about 0.875 inches. Second receptacle 20 may comprise a width dimension d' between about 1.0 inches to about 1.5 inches, between about 1.2 to about 1.3 and more particularly about 1.25 inches. Receptacles 18 and 20 are positioned in this embodiment to extend in a direction along side each other and are laterally spaced apart from one another or, in other words, are spaced apart in a direction generally transverse to a direction handles 56 and 64 will extend when positioned inside of receptacles 18 and 20, as seen in FIGS. 5 and 6. This will similarly be the case for the other embodiments shown in FIG. 3 with receptacles 118 and 120 and in FIG. 4 with receptacles 220 and 218

First and second separators 22 and 24 are positioned between first and second receptacles 18 and 20. First separator 22, integrally formed with top portion 12, may extend approximately 0.1875 inches from top portion 12. Second separator 24, integrally formed with bottom portion 16, may extend approximately 0.375 inches from bottom portion 16.

Peripheral flat edges 26 are typically positioned around top portion 12 and opposing lateral side edges of apparatus 10. Peripheral flat edges 26 may comprise a plurality of indents 52, often circular in shape. This type of construction is designed to resemble a blister pack, which is often used for holding and displaying implements comprising handles and working ends.

Figure 3:
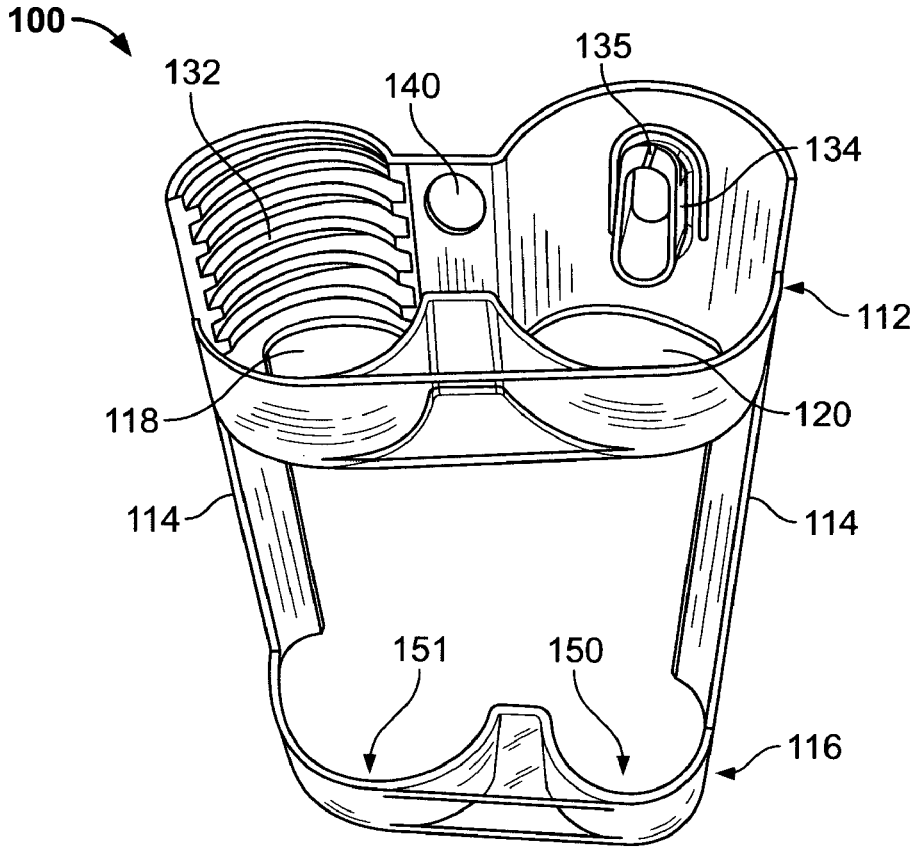
FIG. 3 is a perspective view of a first alternate embodiment of the apparatus of the present invention.

In a first alternate embodiment, shown in FIG. 3, apparatus 100 comprises top portion 112, opposing lateral support members 114 and bottom portion 116. Top portion 112 may comprise threaded portion 132 and post 134, which again may comprise catch 135. Top portion 112 may further comprise hang hole 140. First and second receptacles 118 and 120 may be formed in top portion 112 and comprise concave surfaces oriented toward the rear. Retaining receptacles 150 and 151 are positioned in bottom portion 116. Opposing lateral support members 114 may be positioned between and connected to top portion 112 and bottom portion 116.

Figure 4:
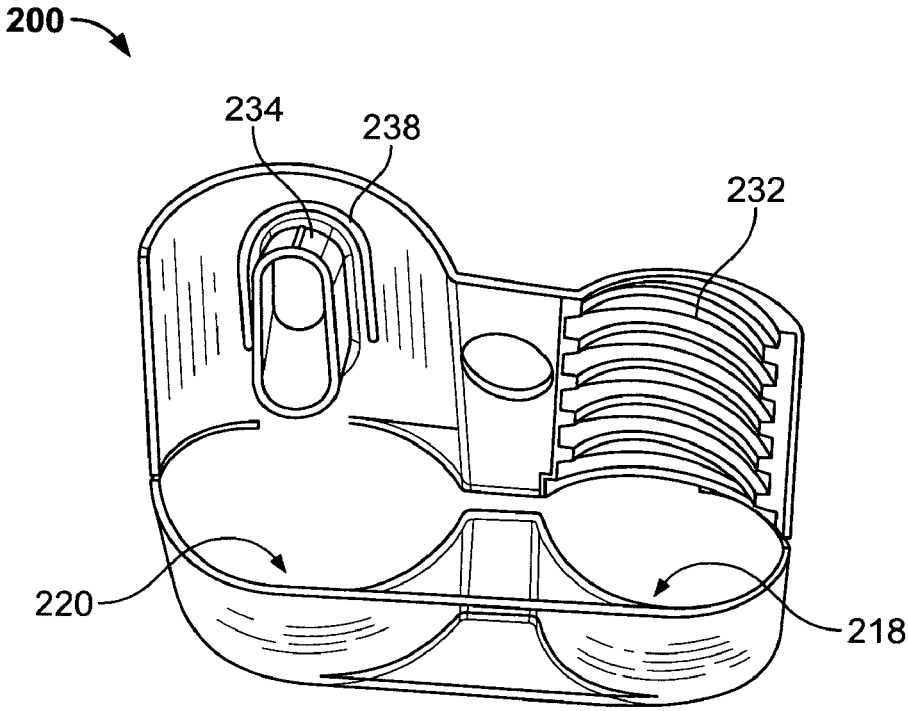
FIG. 4 is a perspective view of a second alternate embodiment of the apparatus of the present invention.

In a second alternate embodiment, shown in FIG. 4, apparatus 200 comprises threaded portion 232 and post 234, which again may comprise catch 235. First and second receptacles 218 and 220 may be respectively positioned in substantial alignment with threaded portion 232 and post 234.

Apparatus 10 is typically constructed of a flexible transparent material, such as a styrene-butadiene copolymer. One suitable example of this type of material is sold under the trade name K-Resin® by the Chevron Phillips Chemical Company. The flexible material may exhibit a flexural modulus, according to ASTM 790 of between about 1550 MPa to about 1650 MPa, with about 1590 MPa being typical. To make apparatus 10, an injection molding process may be employed.

In one embodiment, shown in FIGS. 5 and 6, apparatus 10 is adapted to receive and carry implement 54, comprising handle 56 and working end 58. Typically, handle 56 comprises handle portion 60, integral with working end 58, and handle attachment member 64 for lengthening handle portion 60. Handle portion 60 is releasably securable to handle attachment member 64 by various means known to those of skill in the art. For example, handle portion 60 may be snap fit, interference fit or threadedly engaged with handle attachment member 64. As shown in FIGS. 5 and 6, handle portion 60 includes threaded portion 66, which screws into handle attachment member 64 and which is adapted to mate with threaded portion 32 of top portion 12. Handle attachment member 64 may comprise rounded closed end 68, comprising aperture 70, which is adapted to receive and engage post 34.

In use, implement 54 is installed on apparatus 10 and then displayed to consumers. Referring now to FIG. 5, handle portion 60 may be slid up through bottom portion 16 of apparatus 10 under cover 14 and through first receptacle 18 so that threaded portion 66 is aligned with threaded portion 32. Handle portion 60 may then be threadedly engaged with top portion 12 by pushing threaded portion 66 toward rear surface 30 of top portion 12 so that chamfer 36 engages threaded portion 66 and secures it in place. Under these circumstances, screwing threaded portion 66 into threaded portion 32 is unnecessary, though such action may still be employed to establish a secure connection. Similarly, handle attachment member 64 may be slid up through bottom portion 16 of apparatus 10 under cover 14 and through second receptacle 20 so that aperture 70 is aligned with post 34. To secure handle attachment member 64 to top portion 12, post 34 may be pushed through aperture 70 so that catch 35 contacts a top surface of aperture 70.

With implement 54 in position, cover 14 overlies at least a portion of handle portion 60 and handle attachment member 64 while retaining receptacles 50 and 51 help support the lower end portions of handle portion 60 and handle attachment member 64. With implement in position, length l from a top of top portion 12 to a bottom of working end 58 is no greater than about 40.0 inches and more particularly is about 39.25 inches.

Prior to or after securing implement 54 to apparatus 10, a card containing product information (not shown) may be adhered to raised surface 46 or positioned within the plurality of undercuts 48 on rear surface 44 of cover 14. In this way, apparatus 10 can also be used to readily display product information to consumers.

To remove implement 54 from apparatus 10, the installation process is essentially reversed. Threaded portion 66 of handle portion 60 is disengaged from threaded portion 32 of top portion 12 and handle portion 60 is slid out of apparatus 10 through bottom portion 16. Flexible top portion 12 is bent in a rearward direction (without breaking), thereby disengaging catch 35 from aperture 70 so that handle attachment member 64 can likewise slide out of apparatus 10 through bottom portion 16. Slot 38 positioned around post 34 weakens rear surface 30 to facilitate bending without breaking.

Variations, modifications and other implementations of what is described herein will occur to those of ordinary skill in the art without departing from the spirit and scope of the invention. For example, if an implement comprising a single handle is used, the apparatus of the present invention may be modified to include only a single receptacle, with either one of the threaded portion or post used to secure the handle in position. Accordingly, the invention is in no way limited by the preceding illustrative description.

What is claimed is:

1. An apparatus for carrying an implement comprising a handle and a working end, the apparatus comprising:

a top portion comprising a front surface and a rear surface, the front surface comprising a threaded section and a post transverse to the front surface;

a cover connected to the top portion; and first and second receptacles defined by the cover and top portion wherein the first receptacle and the second receptacle are laterally spaced apart from one another, the first receptacle for receiving a first part of the handle and the second receptacle for receiving a second part of the handle with the first part and the second part of the handle disconnected such that the first part and the second part of the handle are laterally spaced apart from one another.

2. The apparatus of claim 1, wherein the top portion comprises a hole for handing the apparatus on a hook.

3. The apparatus of claim 1, wherein the post comprises a catch for engaging an aperture positioned in the handle.

4. The apparatus of claim 1, wherein the rear surface is constructed of a flexible material to allow disengagement of the post from an aperture positioned in the elongated handle.

5. The apparatus of claim 1, wherein the rear surface of the cover comprises a plurality of undercuts for receipt of a card comprising product information.

6. The apparatus of claim 1, wherein the front portion of the cover comprises a raised surface for carrying a label.

7. The apparatus of claim 1, wherein one of the first and second receptacles comprises a greater width dimension than the other.

8. The apparatus of claim 1, wherein the first receptacle is in substantial alignment with the threaded section and the second receptacle is in substantial alignment with the post.

9. The apparatus of claim 1, further comprising a bottom portion comprising one or more concave surfaces for receiving at least a portion of the handle.

10. The apparatus of claim 1, wherein a length from a top portion of the handle to a bottom portion of the working end is about 40.0 inches.

11. The apparatus of claim 1, wherein the handle comprises a two-part elongated handle and wherein the first part of the handle comprises a handle portion connected to a working end and the second part of the handle comprises a handle attachment member for lengthening the handle portion.

12. An apparatus for carrying an implement comprising a handle and a working end, the apparatus comprising:

a top portion comprising a front surface and a rear surface, the front surface comprising a threaded section and a post transverse to the front surface;

a first receptacle positioned in substantial alignment with the threaded section; and a second receptacle positioned in substantial alignment with the post wherein the first receptacle and the second receptacle are laterally spaced apart from one another, the first receptacle for receiving a first part of the handle and the second receptacle receiving a second part of the handle with the first part and the second part of the handle disconnected such that the first part of the handle and the second part of the handle are laterally spaced apart from one another.

13. The apparatus of claim 12, wherein at least one of the first and second receptacles comprises a concave surface.

14. The apparatus of claim 12, wherein the top portion is constructed of a flexible material to allow disengagement of the post from an aperture positioned in the elongated handle.

15. The apparatus of claim 12, wherein the post comprises a catch for engaging an aperture positioned in the handle.

16. The apparatus of claim 12, wherein one of the first and second receptacles comprises a greater width dimension than the other.

17. The apparatus of claim 12, wherein a length from a top portion of the handle to a bottom portion of the working end is about 40.0 inches.

18. The apparatus of claim 12, wherein the handle comprises a two-part elongated handle and wherein the first part of the handle comprises a handle portion connected to a working end and the second part of the handle comprises a handle attachment member for lengthening the handle portion.

* * * * *